United States Patent [19]

Tremmel

[11] 3,974,044

[45] Aug. 10, 1976

[54] BATH AND METHOD FOR THE ELECTRODEPOSITION OF BRIGHT NICKEL-IRON DEPOSITS

[75] Inventor: Robert Arnold Tremmel, Woodhaven, Mich.

[73] Assignee: Oxy Metal Industries Corporation, Warren, Mich.

[22] Filed: Mar. 31, 1975

[21] Appl. No.: 563,758

[52] U.S. Cl. ..... 204/43 T

[51] Int. Cl.[2] ..... C25D 3/56

[58] Field of Search..... 204/43 T, 43 N, 43 P, 204/123; 427/438; 106/1

[56] References Cited

UNITED STATES PATENTS

| | | | |
|---|---|---|---|
| 3,354,059 | 11/1967 | Koretzky | 204/12 |
| 3,795,591 | 3/1974 | Clauss et al. | 204/43 T |
| 3,804,726 | 4/1974 | Passal | 204/43 T |
| 3,806,429 | 4/1974 | Clauss et al. | 204/41 |
| 3,812,566 | 5/1974 | Clauss | 204/43 T X |
| 3,878,067 | 4/1975 | Tremmel | 204/43 T |

*Primary Examiner*—G. L. Kaplan
*Attorney, Agent, or Firm*—B. F. Claeboe

[57] ABSTRACT

A nickel-iron alloy plating bath containing nickel ions and iron ions, a soluble non-reducing complexing agent, and a reducing saccharide selected from the group consisting of monosaccharides and disaccharides. The combination of hydroxy carboxylic acid complexers and reducing saccharide in such baths yielding high iron content bright level nickel-iron alloy deposits containing up to 50 percent iron, while retaining the $Fe^{+3}$ concentration in the bath at a minimum value and reducing the amount of complexers which is required. Generally, it is preferred to utilize from about 1 to about 50 grams per liter of a reducing saccharide and from about 2 to about 100 grams per liter of the complexing agent.

10 Claims, No Drawings

BATH AND METHOD FOR THE ELECTRODEPOSITION OF BRIGHT NICKEL-IRON DEPOSITS

BACKGROUND OF THE INVENTION

Recently there have been developed decorative coatings of nickel-iron alloy for application to conductive substrates. The electrodeposition of such alloys and suitable baths for such use are disclosed in U.S. Pat. No. 3,806,429, assigned to the assignee of the present invention and in an article entitled "Decorative Coatings of Nickel-Iron Alloy", published in Plating magazine, August, 1973 edition.

As is disclosed in these references, and as practiced in the prior art, bright leveled alloy deposits can be obtained from nickel-iron plating baths containing complexing agents in combination with certain primary and secondary organic brighteners. The complexing agents are hydroxy carboxylic acids, for example, sodium gluconate, sodium citrate and the like.

In general, the prior art nickel-iron plating baths are capable of consistently producing bright, leveled nickel-iron alloy deposits containing up to about 30 percent iron. Alloy deposits of higher iron content have previously been impractical, since higher concentrations of iron in the bath are necessary and thereby even relatively low concentrations of ferric ions are detrimental. Excess ferric iron in the bath reduces the brightness and leveling properties of the deposit, increases the internal stress of the deposit, and reduces ductibility. The problems of ferric iron formation in the bath are even more acute where air agitation is used.

SUMMARY OF THE INVENTION

Normally a small amount of $Fe^{+3}$(0.1 – 0.2 g/l) is desirable in a nickel-iron alloy plating bath in that it helps to promote smoother, brighter and more leveled deposits. However, excessive amounts of $Fe^{+3}$, usually at least 1 g/l or more, will severely hurt the physical properties of the deposit as well as the appearance. Furthermore, when the alloy deposit exceeds 30% iron, the amount of $Fe^{+3}$ present in solution becomes critical. $Fe^{+3}$ concentrations which would not normally interfere in typical nickel-iron alloy deposits, such as those containing about 20 to 25% iron, become quite harmful when the iron in the alloy exceeds 30%. Moreover, higher iron alloy compositions require substantially higher total iron ion concentrations in the plating bath, and therefore, the $Fe^{+3}$ concentration is more likely to be excessive.

By introducing a reducing saccharide into the high iron alloy bath the $Fe^{+3}$ can now be reduced to a minimum, and thereby its harmful effects are limited.

It has now been found that nickel-iron baths can be operated at higher iron ion concentrations and for extended periods of time without the harmful formation of excessive ferric iron by the incorporation into the bath of reducing monosaccharides and disaccharides. Since the saccharides do not themselves effectively complex iron, they are utilized in conjunction with hydroxy carboxylic acid complexing agents, such as sodium gluconate, sodium citrate and the like. When such reducing saccharides and complexing agents are used in combination, bright leveled nickel-iron alloy deposits can be consistently obtained at alloy compositions which exceed about forty percent iron inclusion.

This is essentially due to the utilization of the saccharides which reduce the ferric iron in the bath, thereby keeping the $Fe^{+3}$ concentration of the bath to a minimum. The saccharides also reduce the required amount of the complexing agent.

DESCRIPTION OF THE PREFERRED EMBODIMENTS

This invention is concerned with bath compositions and methods of electrodepositing a bright nickel-iron alloy deposit of enhanced iron content, generally on the order of 25 percent to 50 percent and preferably greater than 35 percent. Such deposits can be used as the basis for subsequent electrodeposition of chromium in order to impart decorative and/or corrosion resistant properties to substrates, such as metals, either with or without an initial layer of electrodeposited semi-bright nickel, copper or the like.

The bath and process of the present invention can also be used in the electrodeposition of a nickel-iron alloy for plastics. Normally the plastic substrate, such as acrylonitrile-butadiene-styrene, polyethylene, polypropylene, polyvinyl, chloride, phenol-formaldehyde polymers, is pretreated by applying onto the plastic substrate a conductive metallic deposit such as nickel or copper. The iron-nickel deposit may then be used as a subsequent coating onto the conductive metallic deposit.

The bath that may be employed in the present invention utilizes one or more salts of nickel, one or more salts of iron, a complexing agent, and a reducing saccharide.

In order to introduce iron and nickel ions into the bath, any bath soluble iron or nickel containing compound may be employed providing the corresponding anion is not detrimental to the bath. Preferably inorganic nickel salts may be employed, such as nickel sulfate, nickel chloride, and the like, as well as other nickel materials such as nickel sulfamate and the like. When nickel sulfate salts are used they are normally present in amounts ranging from 40 to 300 grams per liter (calculated as nickel sulfate $6H_2O$); nickel chloride may also be used and is present in an amount ranging from about 80 to 250 grams per liter. The chloride or halide ions are employed in order to obtain satisfactory conductivity of the solution and at the same time to obtain satisfactory corrosion properties of the soluble anodes.

Preferably the inorganic ferrous salts of iron are employed, such as ferrous sulfate, ferrous chloride, and the like. These salts are present in an amount ranging from about 2 to 60 grams per liter. Other bath soluble iron salts may be employed, such as soluble ferrous fluoborate, or sulfamate, and the like.

The iron complexing agent that is employed in the present invention is one that is bath soluble and contains complexing groups independently selected from the group consisting of carboxy and hydroxy provided at least one of the complexing groups is a carboxy group and further provided that there are at least two complexing groups. The complexing agent that may be employed is present in amounts ranging from about 2 to about 100 grams per liter. Suitable complexing agents are hydroxy substituted lower aliphatic carboxylic acids having from 2 to 8 carbon atoms, from 1 to 6 hydroxyl groups and from 1 to 3 carboxyl groups such as ascorbic acid, isoascorbic acid, citric acid, maleic acid, glutaric acid, gluconic acid, muconic, glucoheptonate, glycollic acid, aspartic acid and the like, as well as the water soluble salts thereof such as ammonium and the alkali metal salts such as potassium, sodium, lithium, and the like. It can also be appreciated that the iron may be introduced into the bath as a salt of the complexing agent.

By "carboxy" is meant the group —COOH. However, it is to be appreciated that in solution the proton disassociates from the carboxy group and therefore this group is to be included in the meaning of carboxy.

The reducing saccharide which is employed as a constituent of the bath of the present invention can be either a monosaccharide or a disaccharide. The monosaccharides can be defined a polyhydroxyaldehydes or polyhydroxyketones with at least three aliphatically bound carbon atoms. The simplest monsaccharides are glyceraldehyde (generally termed aldose) and dihydroxyacetone (generally termed ketose). Other suitable monosaccharides useful in the present invention include dextrose, sorbose, fructose, xylose, erythrose and arabinose. Disaccharides are glucoside-type derivatives of monosaccharides, in which one sugar forms a glucoside with an —OH group of some other sugar. Useful reducing disaccharides include lactose, maltose and turanose. Other disaccharides in which the second monosaccharide may, at least momentarily, possess a free carbonyl group may be utilized.

The purpose of the complexing agent is to keep the metal ions, in particular, the ferrous and ferric ions in solution. It has been found that as the pH of a normal Watts nickel-plating bath increases above a pH of 3.0, ferric ions tend to precipitate as ferric hydroxide. The complexing agent will prevent the precipitation from taking place and therefore makes the iron and nickel ions available for electrodeposition from the complexing agent.

Iron is always introduced into the nickel-iron bath as a ferrous salt but, in the absence of the reducing saccharides of the present invention, a portion of the iron in solution is oxidized from the ferrous to the ferric state. It is believed that this oxidation may be due to the oxidizing of ferrous ions to ferric ions at the anode. Other factors influence the concentration of the ferric ions in the bath. A low pH inhibits the ferrous-to-ferric oxidation, and air agitation of the solution increases the ferric ion concentration over the concentration obtained in the cathode agitated baths.

The reducing saccharides of the present invention reduce the ferric iron in the bath to ferrous iron, thereby keeping the $Fe^{+3}$ concentration to a minimum. Since the formation of ferric iron is inhibited or prevented by the saccharides, less complexing agent is required. Thus, the reducing saccharides of the present invention reduce the amount of complexing agent formerly incorporated in the bath to keep the higher amounts of ferric iron in solution.

This can favorably affect the operation of the bath, since the degradation products formed from excess complexing agent tend to form insoluble metal precipitates which clog anode and filter bags and which cause roughness on the plated cathode. These degradation products can also reduce the amount of iron normally codeposited at a given concentration.

By the use of the combination of a reducing saccharide (of either the mono or di-type) with a hydroxy carboxylic acid complexing agent, the synergistic effects of (1) ferric ion reduction in the bath, (2) lesser amounts of degradation products from the complexing agent, (3) higher iron content in the electrodeposited nickel-iron alloy, and (4) an alloy plate of increased brightness, enhanced leveling, less internal stress and increased ductility is obtained with alloys of very high iron content.

Because of the operating parameters employing the complexing agent, the pH of the bath preferably ranges from about 2.0 to about 5.5 and even more preferably about 3 to about 4.6.

The temperature of the bath may range from about 120°F to about 189°F, preferably about 150°F.

The average cathode current density may range from about 5 to 100 amps per square foot preferably about 45 amps per square foot.

It is preferred that the complexing agent concentration, when used in conjunction with a reducing saccharide, should be at least as great as the total iron ion concentration in the bath. The complexing agent concentration ratio to total iron ion concentration may range from about 1:1 to about 20:1.

It is preferred that the reducing saccharide should be present in an amount ranging from about the amount of the complexing agent to an amount about ten percent of the amount of the complexing agent. The complexing agent concentration ratio to the reducing agent concentration thus, preferably ranges from about 1:1 to about 10:1.

The amount of the reducing saccharide present preferably ranges from about 1 gram per liter to about 50 grams per liter. The amount of saccharide present varies in direct proportion to the amount of iron dissolved in the bath and with the amount of complexing agent present. Further, air agitated baths require greater amounts of saccharide, due to the tendency of such baths to have increased ferric iron content.

The amount of the complexing agent present preferably ranges from about 2 grams per liter to about 100 grams per liter. As above explained, the use of a reducing saccharide in conjunction with the complexing agent substantially reduces the amount of complexing agent previously required.

The bath may also contain various buffers such as boric acid and sodium acetate and the like ranging in amount from about 30 to 60 grams per liter, preferably 40 grams per liter. The ratio of nickel ions to iron ions ranges from about 5:1 to about 50:1.

While the bath may be operated without agitation, various means of agitation may be employed such as mechanical agitation, air agitation, cathode rod movement and the like.

It has been found that various nickel brightening additives may be employed to impart brightness, ductility and leveling to the iron nickel deposits. Suitable additives are the sulfo-oxygen compounds as are described as brighteners of the first class described in "Modern Electroplating" published by John Wiley and Sons, second edition, page 272.

The amount of sulfo-oxygen compounds employed in the present invention ranges from about 0.5 to 10 grams per liter. It has been found that saccharin may be used in amounts ranging from 0.5 to about 5 grams per liter resulting in a bright ductile deposit. When other sulfo-oxygen compounds are employed, such as, naphthalenetrisulfonic, sulfobenzaldehyde, dibenzenesulfonamide, good brightness is obtained but the ductility is not as good as with saccharin. In addition to the above-sulfo-oxygen compounds that may be used, others are sodium allyl sulfonate, benzene sulfinates, vinyl sulfonate, beta-styrene sulfonate, cyano alkane sulfonates (having from 1 to 5 carbon atoms).

The bath soluble sulfo-oxygen compounds that may be used in the present invention are those such as the unsaturated aliphatic sulfonic acids, mononuclear and binuclear aromatic sulfonic acids, mononuclear aromatic sulfinic acids, mononuclear aromatic sulfonamides and sulfonimides, and the like.

It has also been found that acetylenic nickel brighteners may also be used in amounts ranging from about 10 to about 500 milligrams per liter. Suitable compounds are the acetylenic sulfo-oxygen compounds mentioned in U.S. Pat. No. 2,800,440. These nickel brighteners are the oxygen containing acetylenic sulfo-oxygen compounds. Other acetylenic nickel brighteners are those described in U.S. Pat. No. 3,366,557, such as the polyethers resulting from the condensation reaction of acetylenic alcohols and diols such as, propargyl alcohol, butynidiol, and the like and lower alkylene oxide such as epichlorohydrin, ethylene oxide, propylene oxide and the like.

At times the low current denisty areas are not fully bright. To extend the current density range of the iron-nickel bath of the present invention other organic sulfide nickel brighteners are employed in amounts ranging from about 0.5 to about 40 milligrams per liter of the electroplating bath composition. These organic sulfides are of the formula:

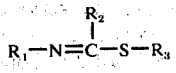

wherin $R_1$ is hydrogen or a carbon atom of an organic radical, $R_2$ is nitrogen or a carbon atom of an organic radical and $R_3$ is a carbon atom of an organic radical. $R_1$ and $R_2$ or $R_3$ may be linked together through a single organic radical. Specific compounds of this type are described in U.S. Pat. No. 3,806,429.

It is to be appreciated that the nickel brighteners must be soluble in the electroplating bath and may be introduced into the bath, when an acid is involved, as the acid itself or as a salt having bath soluble cations, such as ammonium ions, or the alkali metal ions, such as lithium, potassium, sodium, and the like.

It has been found that the use of bright nickel iron deposits of about 10 to 40 percent iron content function as well or better with respect to corrosion than bright nickel deposits in certain composite electroplate systems.

In particular, relatively thin coatings of bright nickel-iron having less than about 0.5-mil thickness (such as 0.1-mil thickness) with an alloy content of about 20 to 50 percent iron, function more effectively than an equivalent bright nickel coating when copper or brass undercoats are employed. In particular, if the iron content is about thirty-five percent or more, the alloy deposits corrode more preferentially to copper or brass undercoats than does bright nickel. This action delays penetration to the basis metal.

These bright nickel-iron coatings also function well as the thin top coat on semi-bright sulfur free nickel deposits. The bright nickel-iron is very effective in such a composite electroplate when overplated with microdiscontinuous chromium coatings such as that described in U.S. Pat. Nos. 3,563,864 and 3,151,971–3. The microdiscontinuous chromium coatings may be achieved by thin nickel deposits which induce microporosity or micro-cracking in the chromium or by plating the chromium deposit from a specific solution which deposits a microcracked chromium.

It can be appreciated that the nickel salts may be substituted with minor amounts up to 50 percent of the nickel salts with cobalt salts in order to achieve different corrosion behavior.

ELECTROPLATING EXAMPLES

The instant invention can be better understood when reference is made to the following examples.

EXAMPLE I

A nickel-iron bath was made up as follows:

| | |
|---|---|
| $NiCl_2.6H_2O$ | 100 g/l |
| $FeSO_4.7H_2O$ | 40 g/l |
| $H_3BO_3$ | 40 g/l |
| Sodium gluconate | 30 g/l |
| Saccharin | 2.0 g/l |
| Allyl sulfonate | 4.0 g/l |
| Acetylenic secondary brighteners | 0.025 g/l |
| pH | 3.2 |
| Temperature | 150° F |
| Air Agitation | |

Panels plated from this solution were bright, but had only fair leveling characteristics, were of poor ductility, and had dark recesses because the iron content of the deposit exceeded 40%.

EXAMPLE II

To the bath of EXAMPLE I above, there was added:

| | |
|---|---|
| Lactose | 10 g/l |

Panels were plated from this solution under the same operating conditions. The electrodeposits were markedly improved, and the plated panels were overall bright, leveled, ductile, with clean, bright recesses. Upon foil analysis, the electroplated deposit contained 50% iron.

EXAMPLE III

A four liter nickel-iron bath was prepared and was analyzed as follows:

| | |
|---|---|
| $NiCl_2.6H_2O$ | 97.7 g/l |
| $Ni^{+2}$ | 35.0 g/l |
| $H_3BO_3$ | 40.7 g/l |
| Fe (total) | 2.41 g/l |
| $Fe^{+2}$ | 2.20 g/l |
| Sodium gluconate | 10 g/l |
| Dextrose | 5 g/l |
| Saccharin | 2.5 g/l |
| Allyl sulfonate | 4.0 g/l |
| Acetylenic secondary brighteners | 0.025 g/l |
| pH | 3.3 |
| Temperature | 150° F |
| Air Agitation | |

Panels were plated from the solution, and the resultant deposits were overall bright, ductile, and had good leveling characteristics. Upon continued operation of the bath, after six hours the ferric iron content was reduced to only 3% of the total iron. Over several days of further electrolysis, the ferric iron content remained between 1 to 5% of the total iron. Further, excellent deposits were obtained having iron contents of up to 35%.

Normally (i.e. without the dextrose content), the ferric iron content would range between 10 to 30%. Also, at such low concentrations of sodium gluconate, it would normally be impossible to obtain such high iron inclusions in the deposit.

EXAMPLE IV

To the bath of EXAMPLE I, there was added:

| | |
|---|---|
| Fructose | 10 g/l |

The results were the same as reported in EXAMPLE II, above.

EXAMPLE V

To the bath of EXAMPLE I, there was added:

| | |
|---|---|
| Sorbose | 10 g/l |

The results were the same as reported in EXAMPLE II, above.

EXAMPLE VI

A cathode rod agitated nickel-iron plating bath was made up and analysed as follows;

| | |
|---|---|
| $NiCl_2.6H_2O$ | 90 g/l |
| $NiSO_4.6H_2O$ | 165 g/l |
| $Ni^{+2}$ | 57.9 g/l |
| $H_3BO_3$ | 39.0 g/l |
| Fe (total) | 10.05 g/l |
| Fe (ferrous) | 9.00 g/l |
| Fe (ferric) | 10 % |
| Sodium gluconate | 22.0 g/l |
| Sodium citrate | 3.0 g/l |
| Lactose | 10.0 g/l |
| pH | 3.4 |
| Temperature | 150° F |
| Saccharin | 3.0 g/l |
| Allyl sulfonate | 3.0 g/l |
| Acetylenic secondary brighteners | 0.025 g/l |

Panels were plated at 45 amp per square foot. The electrodeposits were overall bright and ductile, with excellent leveling and very clean recess areas. The electrodeposit contained 38.8% iron.

The bath was then operated almost continuously for several weeks with the same plating results. After the first day, the ferric iron content never exceeded 1% of the total iron content of the bath.

EXAMPLE VII

A nickel-iron solution was made up as follows:

| | |
|---|---|
| $NiSO_4.6H_2O$ | 75 g/l |
| $NiCl_2.6H_2O$ | 75 g/l |
| $H_3BO_3$ | 50 g/l |
| $FeSO_4.7H_2O$ | 10 g/l |
| Lactose | 20 g/l |
| pH | 3.5 |
| Temperature | 140° F |

This bath was aerated for 1 hour at the above temperature. After this time, a farily large amount of red-brown ferric hydroxide precipitate formed in the bath.

EXAMPLE VIII

A solution identical to that of EXAMPLE VII was made up, but substituting fructose for the lactose. The same results as EXAMPLE VII were obtained.

As illustrated in EXAMPLES VII and VIII, the use of the reducing saccharides without the concurrent use of soluble complexing agents results in unsatisfactory plating solutions.

EXAMPLE IX

A nickel plating solution was prepared having the following analysis:

| | |
|---|---|
| $Ni^{+2}$ | 81.7 g/l |
| $NiCl_2.6H_2O$ | 60.0 g/l |
| $NiSO_4.6H_2O$ | 300.0 g/l |
| $H_3BO_3$ | 40.0 g/l |
| pH | 3.5 |
| Saccharin | 3.0 g/l |
| Sodium Allyl Sulfonate | 6.0 g/l |
| Acetylenic Secondary Brighteners | 0.025 g/l |

The solution was split into two 350 cc plating cells, A and B. 4 g/l of sodium gluconate and 10 g/l of $FeSO_4.7H_2O$ was added to each cell, and in addition 3 g/l of dextrose was added to cell B. The solutions were air agitated for several hours. During aeration a reddish brown ferric hydroxide ppt formed in cell A, while the solution in cell B remained clear.

Panels plated in each bath at 45 ASF for 10 minutes indicated that the deposits plated in cell B (the one containing the dextrose) were substantially superior to those plated in cell A. The deposits from cell A were quite rough and brittle, while those plated in cell B were bright, ductile and very smooth.

Consequently, the use of a reducing saccharide, dextrose, allowed the concurrent use of a lower than normal concentration of a soluble complexing agent.

EXAMPLE X

A one liter high iron plating solution of the nickel-iron type was made up and analyzed as follows:

| | |
|---|---|
| $NiCl_2.6H_2O$ | 46.2 g/l |
| $Ni^{+2}$ | 30.3 g/l |
| $Cl^-$ | 13.7 g/l |
| $H_3BO_3$ | 40.0 g/l |
| Fe (total) | 4.95 g/l |
| $Fe^{+2}$ | 4.79 g/l |
| Saccharin | 3.0 g/l |
| Allyl sulfonate | 4.0 g/l |
| Acetylenic secondary brighteners | 0.025 g/l |
| Sodium gluconate | 20 g/l |
| Lactose | 10 g/l |
| pH | 3.2 |
| Temperature | 150° F |

Panel plating using air agitation produced excellent results. The panel deposits were overall bright and very ductile, with good leveling and very clean recesses. Upon foil analysis, the iron content in the deposit was 41.2%.

The operation of the bath continued for nearly 700 amp-hours per gallon and good results were obtained. The bath was carbon filtered occasionally and periodic additions of brighteners and stabilizers were made.

What is claimed is:

1. An aqueous acidic bath suitable for the electrodeposition of a bright iron-nickel electrodeposit onto a substrate susceptible to corrosion, which comprises iron ions and nickel ions, the ratio of nickel ions to iron ions being from bout 5 to about 50 to 1, an organic sulfo-oxygen compound as a bath soluble primary nickel brightener present in an amount of from about 0.5 to 10 grams per liter, and 2 to 100 grams per liter of a bath soluble complexing agent which is a hydroxy aliphatic carboxylic acid having 1 to 3 carboxyl groups, 2 to 8 carbon atoms and 1 to 6 hydroxyl groups, the ratio of complexing agent to iron ions concentration in the bath being from 1 to about 20 to 1, the bath having a pH from 3.0 to about 4.6, and from about 1 to about 50 grams per liter of a reducing saccharide.

2. In a method for the electrodeposition of a bright iron-nickel electrodeposit onto a substrate susceptible to corrosion, from a bath which includes iron ions and nickel ions, the ratio of nickel ions to iron ions being from about 5 to about 50 to 1, an organic sulfo-oxygen compound as a bath soluble primary nickel brightener being present in the amount of about 0.5 to 10 grams per liter, the improvement of incorporating into the bath from about 10 to about 100 grams per liter of a bath soluble complexing agent which is a hydroxy aliphatic carboxylic acid having 1 to 3 carboxyl groups, 2 to 8 carbon atoms and 1 to 6 hydroxyl groups, and from about 1 to about 50 grams per liter of a bath soluble reducing saccharide.

3. In an aqueous acidic bath suitable for the electrodeposition of a bright iron-nickel electrodeposit onto a conductive substrate, said bath containing iron ions, nickel ions and an organic sulfo-oxygen compound as a primary nickel brightener, the improvement of dissolving into the bath the combination of (1) a complexing agent which is a hydroxy aliphatic carboxylic acid having 1 to 3 carboxyl groups, 2 to 8 carbon atoms and 1 to 6 hydroxyl groups, and (2) a reducing saccharide selected from the group consisting of monosaccharides and disaccharides, the saccharide being present in an amount ranging from about 1 to about 50 grams per liter of the bath, and the complexing agent being present in an amount such that the ratio of complexing agent to iron ion concentration in the bath ranges from about 1:1 to about 20:1, the raio of nickel ions to iron ions being from about 5 to about 50 to 1 the organic sulfo-oxygen compound being present in the amount of about 0.5 to 10 grams per liter.

4. In a method of electrodepositing a bright nickel-iron alloy from an acidic, aqueous bath containing iron ions and nickel ions plus a complexing agent which is a hydroxy aliphatic carboxylic acid having 1 to 3 carboxyl groups, 2 to 8 carbon atoms and 1 to 6 hydroxyl groups and which is present in an amount ranging from 1 to 20 times the concentration of iron ions in the bath, the improvement of reducing the presence of ferric iron ions in the bath by dissolving in the bath 1 to 50 grams per liter of a reducing saccharide selected from the group consisting of mono saccharides and disaccharides, the ratio of nickel ions to iron ions being from about 5 to about 50 to 1, said bath including an organic sulfo-oxygen compound as a bath soluble primary nickel brightener in the amount of about 0.5 to 10 grams per liter.

5. An aqueous acidic bath as defined in claim 4, in which the reducing saccharide is selected from the group consisting of lactose, dextrose and fructose.

6. In a method of electrodepositing a bright nickel-iron alloy from an acidic, aqueous bath containing iron ions and nickel ions, the improvement of adding to the bath the combination of (1) a bath soluble reducing saccharide and (2) a bath soluble complexing agent which is a hydroxy aliphatic carboxylic acid having 1 to 3 carboxyl groups, 2 to 8 carbon atoms and 1 to 6 hydroxyl groups, the saccharide being present in an amount ranging from about 1 to about 50 grams per liter of the bath, and the complexing agent to saccharide concentration ratio ranging from about 1:1 to about 10:1, the ratio of nickel ions to iron ions being from about 5 to about 50 to 1, said bath including an organic sulfo-oxygen compound as a bath soluble primary nickel brightener in the amount of about 0.5 to 10 grams per liter.

7. A method of electrodepositing a bright nickel-iron alloy as defined in claim 6, in which the reducing saccharide is selected from the group consisting of lactose, dextrose and fructose.

8. In a method of electrodepositing a bright iron-nickel electrodeposit from an aqueous acidic bath onto a conductive substrate, said bath containing iron ions, nickel ions and an organic sulfo-oxygen compound as a primary nickel brightener, the step of dissolving into the bath the combination of (1) a complexing agent which is a hydroxy aliphatic carboxylic acid having 1 to 3 carboxyl groups, 2 to 8 carbon atoms and 1 to 6 hydroxyl groups, and (2) a reducing saccharide selected from the group consisting of monosaccharides and disaccharides, the saccharide being present in an amount ranging from about 1 to about 50 grams per liter of the bath, and the complexing agent being present in an amount ranging from about 2 to about 100 grams per liter, the ratio of nickel ions to iron ions being from about 5 to about 50 to 1.

9. In a bath for electrodepositing a bright nickel-iron alloy and wherein the acidic, aqueous bath contains iron ions and nickel ions plus a complexing agent which is a hydroxy aliphatic carboxylic acid having 1 to 3 carboxyl groups, 2 to 8 carbon atoms and 1 to 6 hydroxyl groups and which is present in an amount ranging from 1 to 20 times the concentration of iron ions in the bath, the improvement of dissolving in the bath from about 1 to 50 grams per liter of a reducing saccharide selected from the group consisting of monosaccharides and disaccharides, the ratio of nickel ions to iron ions being from about 5 to about 50 to 1, the amount of complexing agent being present in the amount of about 10 to 100 grams per liter, and said bath including as a primary nickel brightener about 0.5 to 10 grams per liter of an organic sulfo-oxygen compound.

10. In an aqueous, acidic bath for electrodepositing a bright nickel-iron alloy containing iron ions and nickel ions, the improvement of adding to the bath and in combination (1) a bath soluble reducing saccharide and (2) a bath soluble complexing agent which is a hydroxy aliphatic carboxylic acid having 1 to 3 carboxyl groups, 2 to 8 carbon atoms and 1 to 6 hydroxyl groups, the saccharide being present in an amount ranging from about 1 to about 50 grams per liter of the bath and the complexing agent to saccharide concentration ranging from about 1:1 to about 10:1, the ratio of nickel ions to iron ions being from about 5 to about 50 to 1, and said bath including an organic sulfo-oxygen compound as a bath soluble primary nickel brightener in the amount of about 0.5 to 10 grams per liter.

* * * * *